US007198482B2

(12) United States Patent
Chung et al.

(10) Patent No.: US 7,198,482 B2
(45) Date of Patent: Apr. 3, 2007

(54) COMPACT LOW $NO_X$ GAS BURNER APPARATUS AND METHODS

(75) Inventors: I-Ping Chung, Tulsa, OK (US); Jesse Steven Chambers, Skiatook, OK (US); Carol Ann Schnepper, Tulsa, OK (US); Roger L. Poe, Beggs, OK (US); Jaiwant D. Jayakaran, Tulsa, OK (US); Richard T. Waibel, Broken Arrow, OK (US); Michael G. Claxton, Tulsa, OK (US); Marianne Zimola, Owasso, OK (US); Darin Robert Foote, Tulsa, OK (US)

(73) Assignee: John Zink Company, LLC, Tulsa, OK (US)

( * ) Notice: Subject to any disclaimer, the term of this patent is extended or adjusted under 35 U.S.C. 154(b) by 450 days.

(21) Appl. No.: 10/796,740

(22) Filed: Mar. 9, 2004

(65) Prior Publication Data

US 2005/0175945 A1 Aug. 11, 2005

(51) Int. Cl.
*F23M 3/00* (2006.01)
*F23C 9/00* (2006.01)

(52) U.S. Cl. ..... 431/9; 431/8; 431/116

(58) Field of Classification Search ..... 431/9, 431/8, 116, 115, 173, 181, 187, 285
See application file for complete search history.

(56) References Cited

U.S. PATENT DOCUMENTS

| | | | | |
|---|---|---|---|---|
| 2,918,117 | A | 12/1959 | Griffin | |
| 4,004,875 | A | 1/1977 | Zink et al. | |
| 5,073,105 | A | 12/1991 | Martin et al. | |
| 5,195,884 | A | 3/1993 | Schwartz et al. | |
| 5,238,395 | A | 8/1993 | Schwartz et al. | |
| 5,275,552 | A | 1/1994 | Schwartz et al. | |
| 5,284,438 | A | 2/1994 | McGill et al. | |
| 5,407,347 | A | 4/1995 | Bortz | |
| 5,458,481 | A | 10/1995 | Surbey et al. | |
| 5,542,840 | A | 8/1996 | Surbey et al. | |
| 5,899,681 | A * | 5/1999 | Maughan | 431/8 |
| 5,984,665 | A | 11/1999 | Loftus et al. | |
| 5,993,193 | A | 11/1999 | Loftus et al. | |
| 6,007,325 | A | 12/1999 | Loftus et al. | |
| 6,394,792 | B1 | 5/2002 | McDonald et al. | |
| 6,499,990 | B1 | 12/2002 | Zink et al. | |
| 6,672,858 | B1 | 1/2004 | Benson et al. | |
| 2002/0197574 | A1 * | 12/2002 | Jones et al. | 431/8 |

* cited by examiner

FOREIGN PATENT DOCUMENTS

WO WO95/129365 11/1995

*Primary Examiner*—Alfred Basichas
(74) *Attorney, Agent, or Firm*—McAfee & Taft

(57) ABSTRACT

Compact low $NO_x$ gas burner apparatus and methods for discharging fuel gas and air mixtures into furnace spaces wherein the mixture is burned in folded flame patterns and flue gases having low $NO_x$ content are formed are provided. A burner apparatus of the invention is basically comprised of a housing having a burner tile attached thereto and means for introducing air therein. The burner tile has an opening therein with a wall surrounding the opening which extends into a furnace space. The exterior sides of the wall are divided into sections by radially positioned baffles with alternate sections having the same or different heights and slanting towards the opening at the same or different angles. Primary fuel gas mixed with flue gases and air is discharged through the burner tile. Secondary fuel gas is discharged adjacent to the external slanted wall sections whereby the secondary fuel gas mixes with flue gases in the furnace space. The resulting fuel gas-flue gases streams mix with the fuel gas-flue gases-air mixture discharged through the burner tile and the resulting mixture is burned in the furnace space.

54 Claims, 5 Drawing Sheets

COMPACT LOW $NO_X$ GAS BURNER APPARATUS AND METHODS

BACKGROUND OF THE INVENTION

1. Field of the Invention

The present invention relates to gas burner apparatus and methods for burning fuel gas-air mixtures whereby flue gases having low $NO_x$ content are produced.

2. Description of the Prior Art

Emission standards are continuously being imposed by governmental authorities which limit the quantities of gaseous pollutants such as oxides of nitrogen ($NO_x$) which can be emitted into the atmosphere. Such standards have led to the development of various improved gas burner designs which lower the production of $NO_x$ and other polluting gases. For example, methods and apparatus have been developed wherein all of the air and some of the fuel is burned in a first zone and the remaining fuel is burned in a second zone. In this staged fuel approach, an excess of air in the first zone acts as a diluent which lowers the temperature of the burning gases and thereby reduces the formation of $NO_x$. Other methods and apparatus have been developed wherein flue gases are combined with fuel gas and/or fuel gas-air mixtures to dilute the mixtures and lower their combustion temperatures and the formation of $NO_x$.

While the above described prior art methods and burner apparatus for producing flue gases having low $NO_x$ content have achieved varying degrees of success, there still remains a need for improvement in gas burner apparatus and methods of burning fuel gas whereby simple economical burner apparatus is utilized and low $NO_x$ content flue gases are produced. Further, the burner apparatus utilized heretofore to carry out the above described methods have generally been large, produce flames of long length and have low turn down ratios.

Thus, there are needs for improved burner apparatus and methods which produce low $NO_x$ content flue gases and the burner apparatus are compact, have short flame lengths and have high turn down ratios.

SUMMARY OF THE INVENTION

By the present invention compact low $NO_x$ gas burner apparatus and methods are provided which meet the needs described above and overcome the deficiencies of the prior art. That is, the present invention provides improved gas burner apparatus and methods for discharging mixtures of fuel gas and air into furnace spaces wherein the mixtures are burned and flue gases having low $NO_x$ content are formed therefrom. In addition, the compact burner apparatus of this invention are smaller than most prior art burner apparatus, have high turn down ratios and produce short flame lengths.

A compact gas burner apparatus of this invention is basically comprised of a housing having an open end attached to a furnace space and means for introducing a controlled flow rate of air into the housing attached thereto. A refractory burner tile is attached to the open end of the housing having an opening formed therein for allowing air to pass from the housing into the furnace space. The burner tile includes a wall surrounding the opening which extends into the furnace space and forms a mixing zone within and above the wall. The exterior sides of the wall are divided into sections by a plurality of radially positioned baffles attached thereto with alternate sections having the same or different heights and slanting towards the opening at the same or different angles. Some or all of the sections, preferably every other section, have passageways formed therein for conducting primary fuel gas from outside the sections to within the wall. A primary fuel gas nozzle connected to a source of fuel gas can optionally be positioned within the opening and wall of the burner tile for mixing additional primary fuel gas with the air flowing through the burner tile. One or more fuel gas nozzles, preferably one for each external slanted wall section, connected to a source of fuel gas and positioned outside the wall of the burner are provided for discharging secondary fuel gas adjacent to one or more of the sections. One or more of the fuel gas nozzles, preferably every other fuel gas nozzle, also discharge primary fuel gas and flue gases into and through the primary fuel gas passageways whereby the secondary fuel gas mixes with flue gases in the furnace space, the mixture of secondary fuel gas and flue gases mixes with unburned air, primary fuel gas and flue gases flowing through the opening and wall of the burner tile and the resultant mixture is burned in the furnace space in a folded flame pattern. The one or more of the alternating sections with primary fuel gas passageways formed therein having one or more deflectors attached thereto for deflecting the secondary fuel gas into separate streams that do not interact with each other.

By the improved methods of the present invention a mixture of fuel gas and air is discharged into a furnace space wherein the mixture is burned in a folded flame pattern and flue gases having low $NO_x$ content are formed therefrom. A method of this invention basically comprises the steps of discharging the air into a mixing zone within and adjacent to a wall which extends into the furnace space and has exterior sides divided into alternating sections by a plurality of radially positioned baffles attached thereto. The alternating sections have the same or different heights and slant towards the opening at the same or different angles. One or more of the sections, preferably every other section of the alternating sections, have passageways formed therein for conducting a primary fuel gas and flue gases mixture from outside the sections to within the wall. A primary portion of the fuel gas is discharged from locations outside the wall and adjacent to the one or more wall sections having passageways formed therein so that the primary portion of the fuel gas is mixed with flue gases in the furnace space and the resulting primary fuel gas-flue gases mixture formed flows into the mixing zone within the wall by way of the one or more passageways to form a primary fuel gas-flue gases-air mixture which flows into the furnace space. Simultaneously, a secondary portion of the fuel gas is discharged from one or more locations outside the wall and adjacent to one or more of the wall sections so that the secondary portion of fuel gas mixes with flue gases in the furnace space and the secondary fuel gas-flue gases mixture formed is discharged into the primary fuel gas-flue gases-air mixture in a plurality of separate streams which enter and mix with the primary fuel gas-flue gases-air mixture to form a highly mixed fuel gas-flue gases-air mixture which burns in a folded flame pattern, the one or more wall sections with passageways formed therein having one or more deflectors attached thereto for deflecting the secondary portion of the fuel gas into separate streams that do not interact with each other.

The objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 8 is a perspective view of a burner tile similar to the burner tile of FIG. 6 except that instead of one secondary fuel gas deflector block, each of the alternate sections have two deflector blocks attached thereto.

FIG. 9 is a top view of the burner tile of FIG. 8.

DESCRIPTION OF PREFERRED EMBODIMENTS

Figure 2:
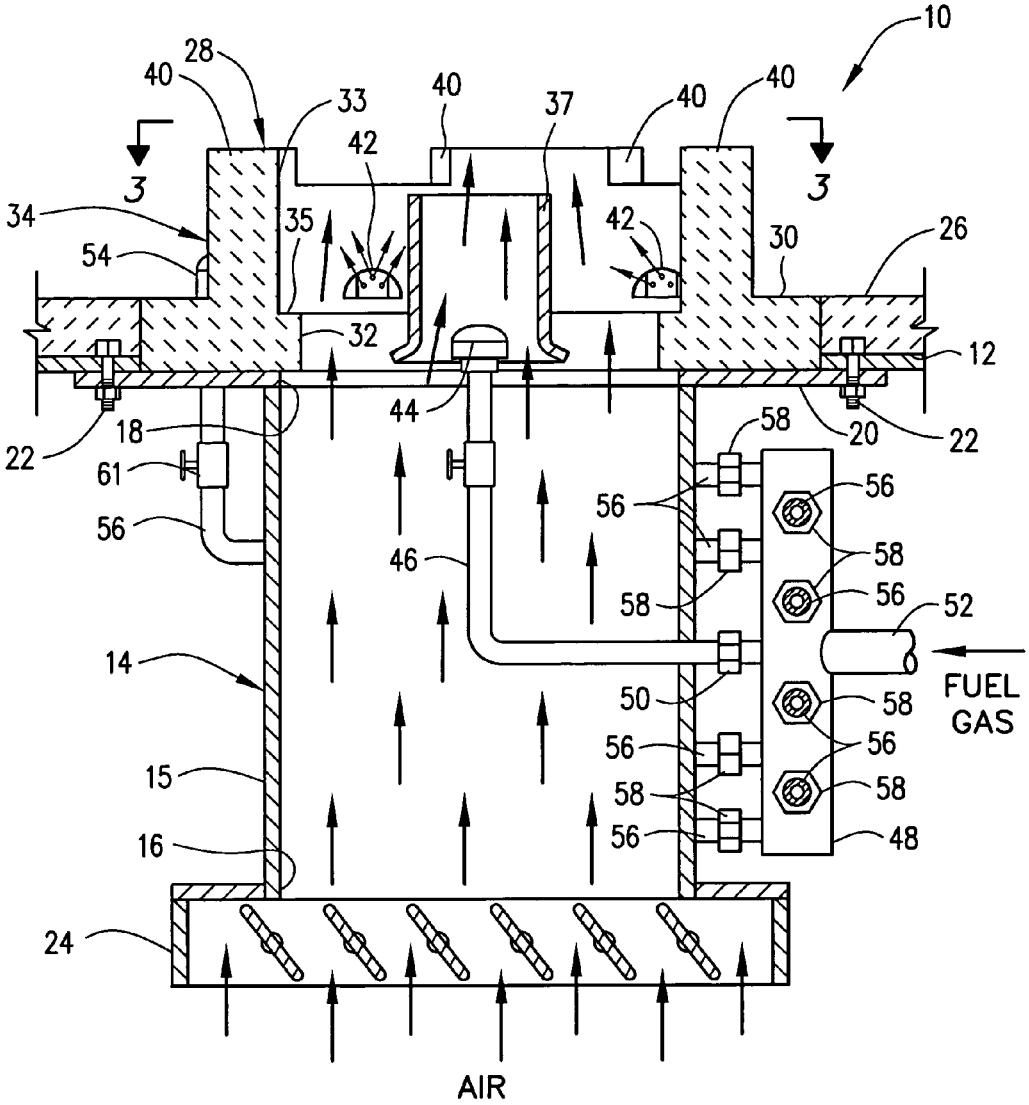
FIG. 2 is a side cross-sectional view of the burner apparatus of the present invention attached to a furnace wall including the burner tile of FIG. 1 with the view of the burner tile being taken along line 2—2 of FIG. 1.

Referring now to the drawings, a compact, low $NO_x$, gas burner apparatus of the present invention is illustrated and generally designated by the numeral 10. As best shown in FIG. 2, the burner apparatus 10 is sealingly attached to the bottom wall 12 of a furnace space over an opening therein. While gas burner apparatus are commonly mounted vertically and fired upwardly as shown in FIG. 2, it is to be understood that the burner apparatus can also be mounted horizontally and fired horizontally or vertically and fired downwardly. The burner apparatus 10 is comprised of a housing 14 having an open end 16 and an open end 18. The housing 14 is attached to the furnace wall 12 by means of a flange 20 and a plurality of bolts 22 which extend through complimentary openings in the flange 20 and the wall 12. An air flow rate regulating register 24 is connected to the housing 14 at its open end 16 for regulating the flow rate of combustion air entering the housing 14. The furnace wall 12 includes an internal layer of insulating material 26 attached thereto, and the open end 18 of the housing 14 includes a burner tile 28 formed of flame and heat resistant refractory material attached thereto. As illustrated in FIG. 2, the interior surface of the insulating material 26 attached to the furnace wall 12 and the top of the base portion 30 of the burner tile 28 define a furnace space within which the fuel gas and air discharged by the burner apparatus 10 are burned. The burner tile 28 has a central opening 32 formed in the base portion 30 thereof through which air introduced into the housing 14 by way of the air register 24 is discharged. The burner tile 28 also includes a recessed wall portion 34 which surrounds the opening 32, forms a circular ledge 35 and extends into the furnace space. The burner tile 28, the interior 33 of the wall portion 34 and the central opening 32 in the base portion 30 of the burner tile 28 as well as the housing 14 can take various shapes, e.g., circular, rectangular, square, triangular, polygonal or other shape. However, the burner apparatus 10 preferably includes a circular burner tile 28 having a circular opening 32 therein and a circular wall portion 34. Also, the housing 14 preferably includes a circular opening 18 therein and the housing is preferably cylindrical. However, the housing can also include a square opening 18 therein and can have square or rectangular sides 15. In a preferred embodiment as shown in FIG. 2, the opening 32 in the burner tile 28 is smaller than the interior sides 33 of the wall 34 thereof so that a ledge 35 is provided within the tile 28 which functions as a flame stabilizing surface.

Figure 1:
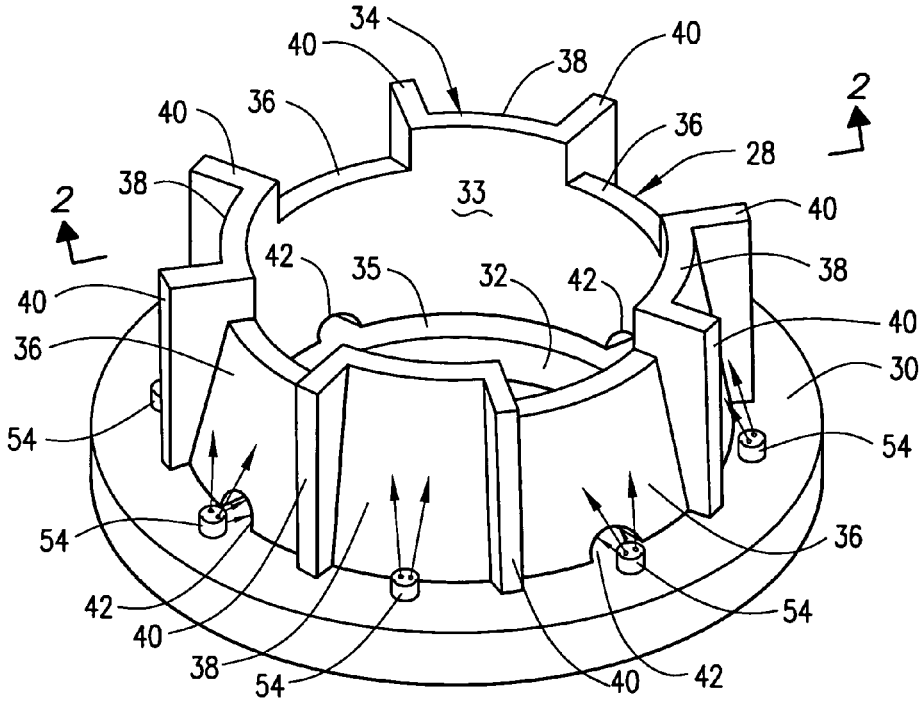
FIG. 1 is a perspective view of the burner tile of the present invention which includes a wall divided into sections by a plurality of radial baffles with alternate sections having different heights and slanting towards the opening at different angles.

Referring now to FIG. 1, a perspective view of the burner tile 28 and the wall 34 thereof is shown. The interior sides of the wall 34 are vertical as best shown in FIG. 2. The exterior sides of the wall 34 are divided into a plurality of sections 36 and 38 by radially positioned baffles 40 with the alternate sections 36 and 38 having the same or different heights and slanting towards the opening 32 at the same or different angles. Preferably, the alternating sections have different heights and slant at different angles as shown in the drawings.

Figure 3:
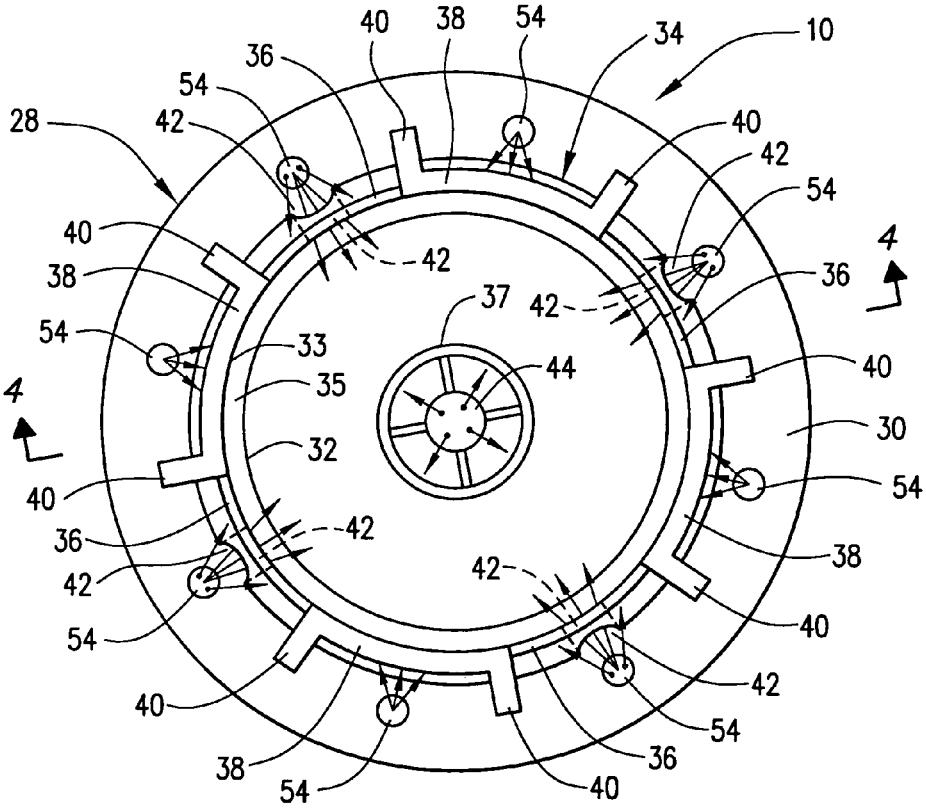
FIG. 3 is a top view of the burner of FIG. 2 taken along line 3—3 of FIG. 2.
Figure 4:
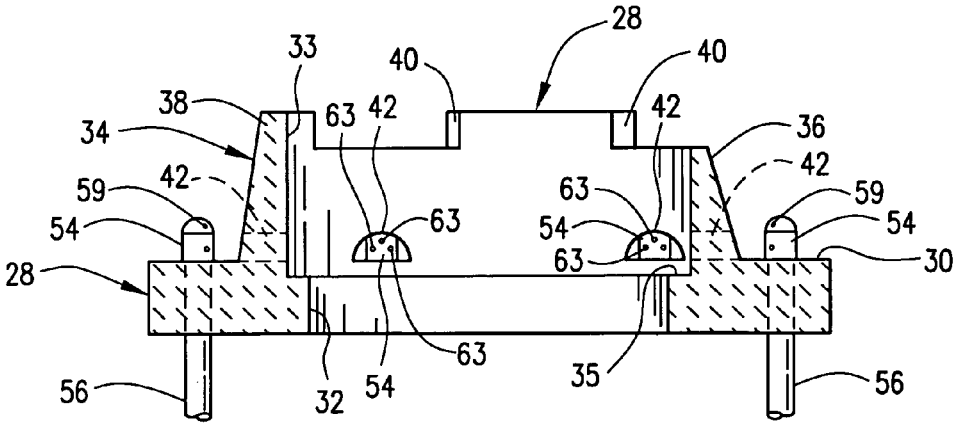
FIG. 4 is a side cross-sectional view of the burner tile taken along line 4—4 of FIG. 3.

Referring now to FIG. 4, it can be seen that in a preferred embodiment the sections 36 have short heights and slant towards the opening 32 in the burner tile 34 at large angles as compared to the sections 38 which have taller heights and slant toward the opening 32 at smaller angles. As will now be understood and as shown in FIGS. 1–4, the sections 36 and 38 between the baffles 40 alternate around the wall 34. In the embodiment illustrated in the drawing, there are four of the sections 36 and four of the sections 38. Depending on the size of the burner, there can be more or less of the alternating sections with the totals being even numbers, e.g., 4, 6, 8, 10, etc.

The alternating sections 36 have heights in the range of from about 0 inches to about 16 inches and slant towards the opening 32 at an angle in the range of from about 0 degrees to about 90 degrees. The alternating sections 38 can have the same or different heights as the alternating sections 36 in the range of from about 2 inches to about 16 inches and slant towards the opening 32 at the same or different angles in the range of from about 0 degrees to about 60 degrees. Preferably, the alternating sections 36 have heights in the range of from about 0 inches to about 16 inches and slant in the range of from about 0 degrees to about 90 degrees and the alternating sections 38 have different heights in the range of from about 2 inches to about 16 inches and slant differently in the range of from about 0 degrees to about 60 degrees. As shown best in FIGS. 2–4, the sections 36 each include a passageway 42 extending from the outside to the inside of the wall 34 through which fuel gas mixed with flue gases flow as will be described further hereinbelow.

In a more preferred arrangement of the alternating sections 36 and 38, the first of the alternating sections have heights in the range of from about 5 inches to about 10 inches and slant towards the opening at an angle in the range of from about 10 degrees to about 30 degrees, and the second of the alternating sections have the same or different heights as the first of the alternating sections in the range of from about 6 inches to about 12 inches and slant towards the opening at the same or different angles in the range of from about 5 degrees to about 15 degrees.

In a presently preferred arrangement, the first of the alternating sections have heights of about 7 inches and slant towards the opening at an angle of about 20 degrees, and the second of the alternating sections have heights of about 9 inches and slant towards the opening at an angle of about 10 degrees.

As shown in FIGS. 2 and 3, a central primary fuel gas nozzle 44 can optionally be positioned within the opening 32 near the bottom of the burner tile 28. When used, the nozzle 44 is connected by a conduit 46 to a fuel gas manifold 48. The conduit 46 is connected to the manifold 48 by a union 50 and a conduit 52 connected to the manifold 48 is connected to a source of pressurized fuel gas. As shown in FIGS. 2 and 3, a venturi 37 can optionally be positioned around and above the nozzle 44 so that a fuel gas lean mixture of fuel gas and air is formed and combusted in and above the venturi 37. Also, the burner 14 can optionally include a plurality of nozzles 44 and venturis 37 in lieu of the single nozzle 44 and venturi 37.

As best shown in FIGS. 2 and 3, positioned in spaced relationship on the surface 30 of the burner tile 28 adjacent to the bottoms of the sections 36 and 38 of the wall 34 are a plurality of secondary fuel gas discharge nozzles 54. The nozzles 54 are positioned adjacent the intersections of the sections 36 and 38 with the surface of the base portion 30 of the burner tile 28. The nozzles 54 are connected to fuel gas conduits 56 (FIG. 2) which are connected to the fuel gas manifold 48 by unions 58. As shown in one of the conduits 56 in FIG. 4, each of the conduits 56 have a shut-off valve 61 disposed therein. The nozzles 54 positioned adjacent to the sections 38 include fuel gas discharge openings therein whereby secondary fuel gas is discharged in fan shapes substantially parallel and adjacent to the exterior surfaces of the sections 38. The nozzles 54 positioned adjacent to the sections 36 include two or more fuel gas discharge ports therein whereby secondary fuel gas is discharged in streams substantially parallel and adjacent to the exterior surfaces of the sections 36. As the secondary fuel gas discharged by the nozzles 54 flows over the surfaces of the sections 36 and 38, flue gases in the furnace space outside the burner tile 28 are mixed with the secondary fuel gas.

The passageways 42 in the sections 36 are positioned adjacent to the nozzles 54 as illustrated best in FIG. 3. In addition to the fuel gas discharge ports for discharging secondary fuel gas parallel to the surfaces of the sections 36, the fuel gas nozzles 54 adjacent to the sections 36 and the passageways 42 formed therein include primary fuel gas discharge ports for discharging primary fuel gas into the interior of the opening 32 and the wall 34 of the burner tile 28. Because of the primary fuel gas jets flowing through the openings 42, furnace space flue gases outside of the burner tile 28 are drawn into and flow through the openings 42 with the primary fuel gas into the interior of the opening 32 and wall 34 of the burner tile 28.

While the passageways 42 with primary fuel gas jets and flue gases flowing therethrough are preferably located in every other section as described above, it is to be understood that one or more passageways 42 with primary fuel gas jets and flue gases flowing therethrough can be utilized in the wall 34 of the burner tile 28.

Figure 5:
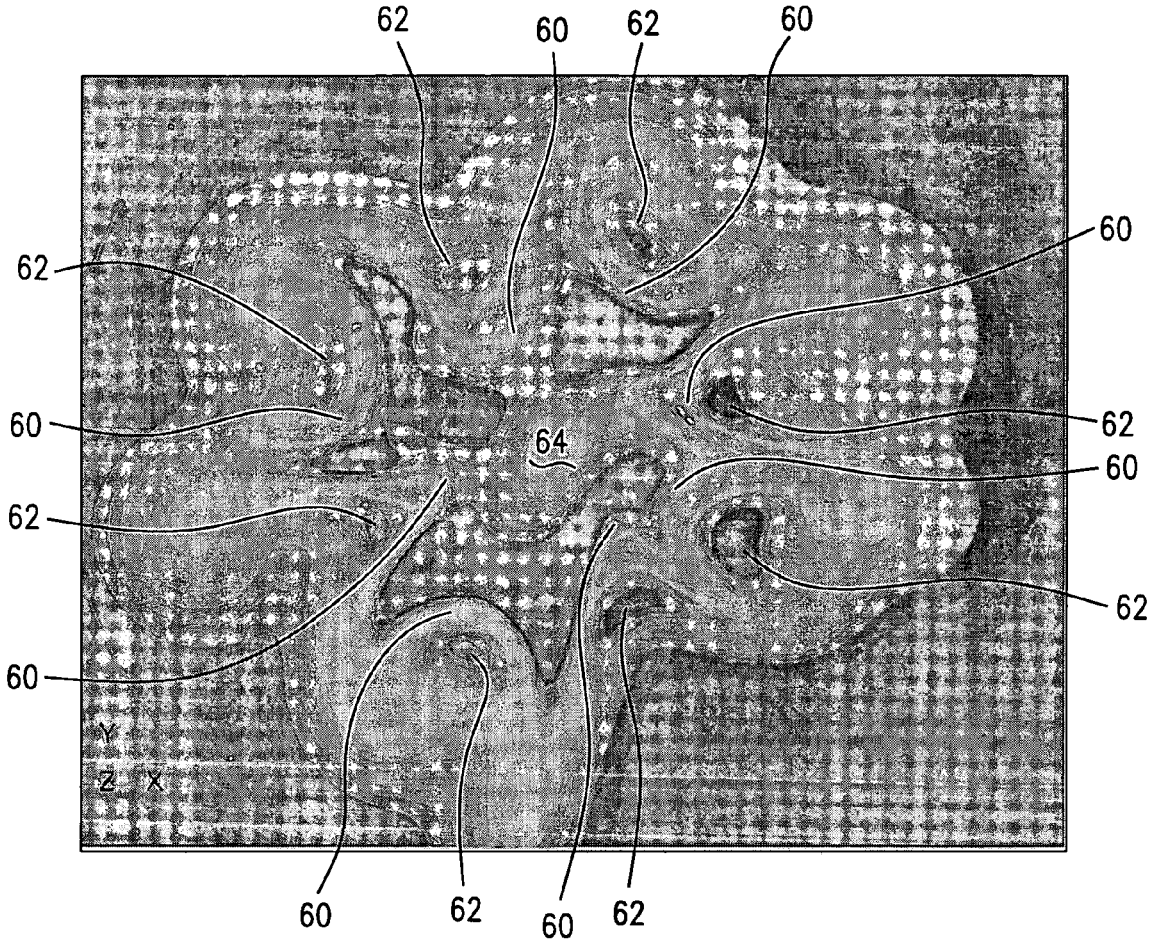
FIG. 5 is a picture of the folded flame pattern produced by the burner apparatus and methods of this invention.

In addition to defining the sections 36 and 38, the baffles function to divide the secondary fuel gas and flue gases into a plurality of separate streams which enter and intimately mix with the primary fuel gas-flue gases-air mixtures discharged from within the wall 34 of the burner tile 28. The primary fuel gas-flue gases-air mixtures formed within the wall 34 are ignited while within the wall 34 and then flow out of the wall 34. The collisions of the secondary fuel gas-flue gases streams with the primary fuel gas-flue gases-air mixtures create a plurality of U-shaped or folded flames 60 as shown in FIG. 5. As is well known by those skilled in the art, one of the primary mechanisms that produce $NO_x$ in a combustion process is thermal $NO_x$, i.e., the higher the flame temperature, the more $NO_x$ that is created. In the burner apparatus of this invention, the multiplicity of folded flames 60 shown in FIG. 5 allow the fuel gas to be rapidly mixed with flue gases prior to and during burning with air thereby reducing $NO_x$. Also, the increased surface area of the folded and convoluted flames 60 causes flue gases to mix with the flames more effectively, and the breaks 62 in the flames that exist between the folds allow flue gases to further penetrate between the flames and mix therewith, all of which contribute to very low $NO_x$ production.

As mentioned above, the nozzles 54 adjacent to the section or sections 36 include one or more primary fuel gas ports 63 (FIG. 4) that discharge primary fuel gas horizontally through the passageways 42 in the section or sections 36 and two or more secondary fuel gas ports 59 that discharge secondary fuel gas streams substantially parallel and adjacent to the exterior surfaces of the section or sections 36. The secondary fuel gas flows over the surfaces of the section or sections 36, mixes with flue gases from the furnace space and mixes with the primary fuel gas-air mixture flowing from the interior of the wall 34 whereby the resulting mixture is diluted by the relatively cool excess air and flue gases and burns in folded flames that produce flue gases of low $NO_X$ content.

A problem that sometimes occurs is that the secondary fuel gas streams that are discharged from the ports 59 of one or more nozzles 54 parallel and adjacent to the exterior surfaces of one or more sections 36 mix and interact whereby the mixing with flue gases, primary fuel gas and air is reduced. As a result, the flame produced is less stable and the total burner $NO_X$ emissions are increased. This problem is eliminated in accordance with the present invention by the provision of one or more secondary fuel gas deflectors, preferably deflector blocks formed on or attached to the section or sections 36 of the burner tile 28. As will be understood by those skilled in the art, the deflectors can be of a variety of shapes and designs so long as the separate streams discharged from the ports 59 of the nozzles 54 do not mix and interact. For example, when the deflectors are in the form of blocks, the blocks can be of any geometry such as triangular, rectangular, square or trapezoidal, etc.

Figure 6:
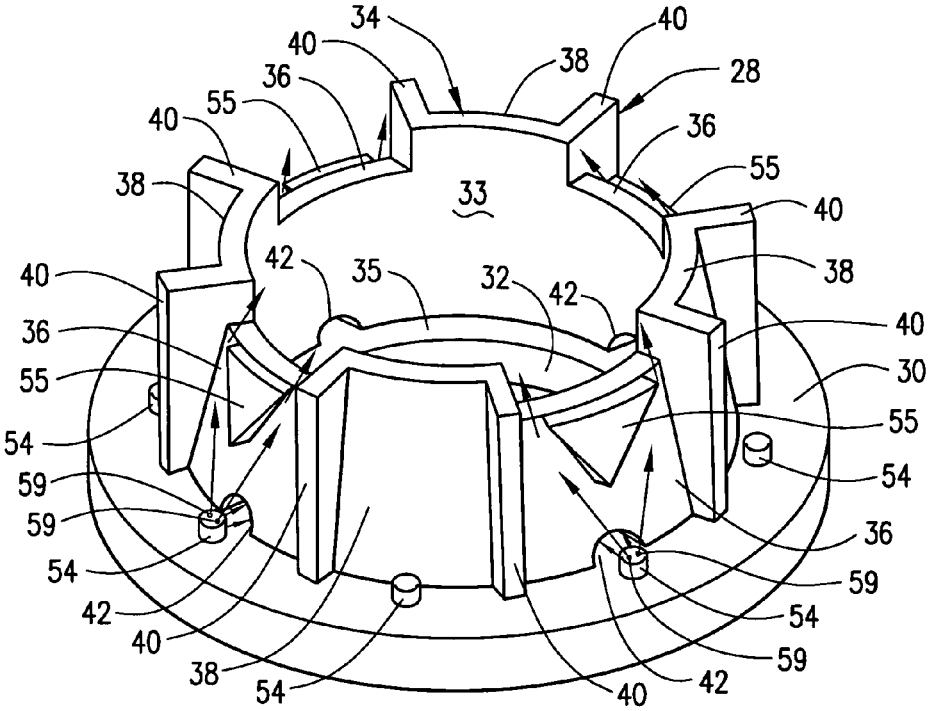
FIG. 6 is a perspective view of a burner tile of the present invention similar to FIG. 1 except that the alternate sections having primary fuel gas passageways formed therein also each have a secondary fuel gas deflector block attached thereto.
Figure 7:
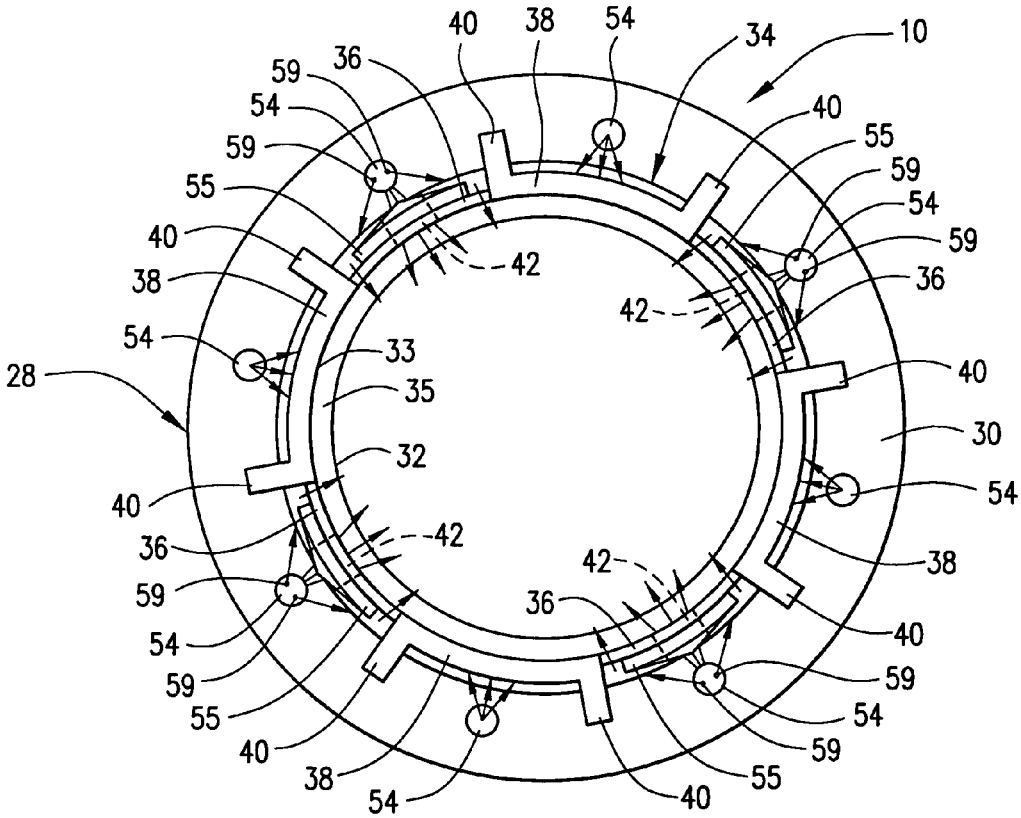
FIG. 7 is a top view of the burner tile of FIG. 6.
Figure 5:
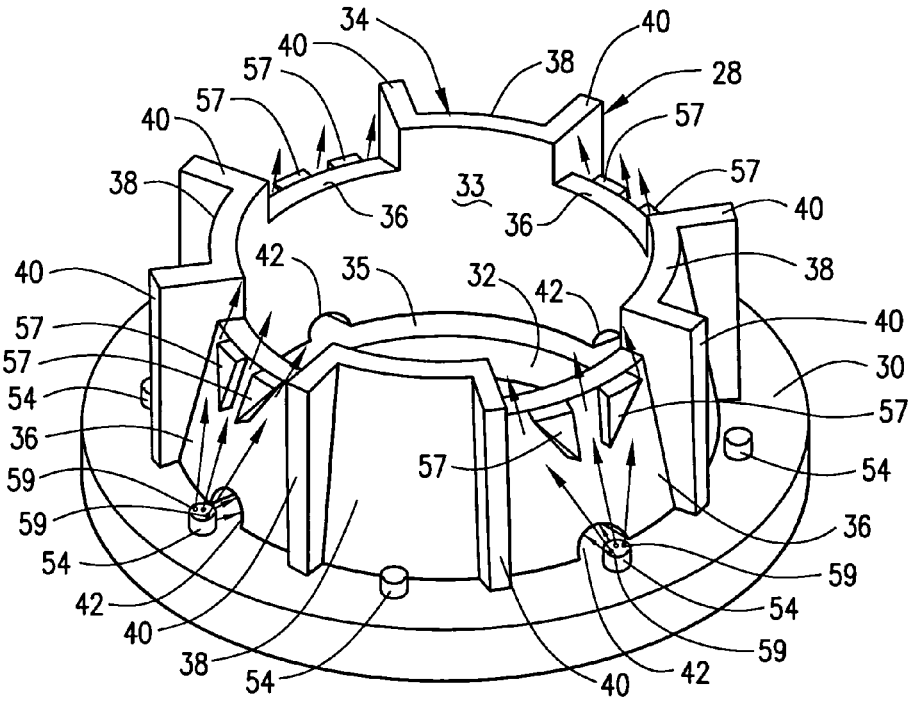
Figure 6:
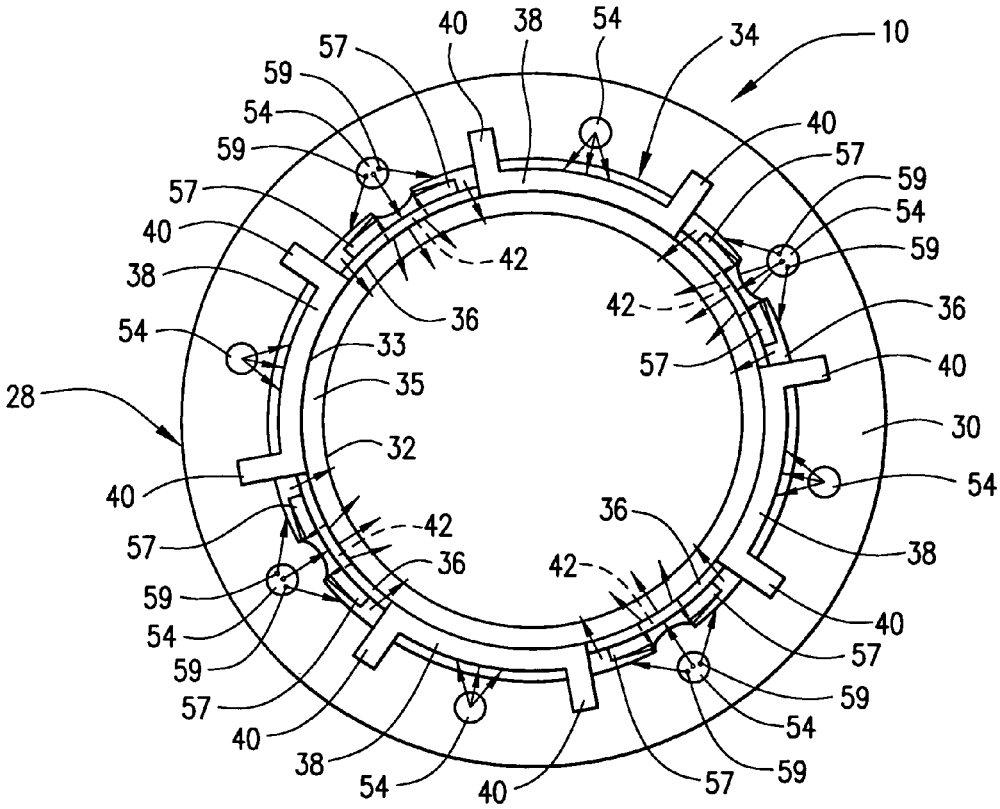

Referring to FIGS. 6 and 7, a perspective view and a top view of the burner tile 28 are shown, the burner tile 28 having an equilateral triangle shaped secondary fuel gas deflector block 55 attached to each of the sections 36. As best shown in FIG. 6, the triangle shaped deflector blocks 55 are positioned with the bases thereof coinciding with the tops of the sections 36 and the apexes pointing towards the passageways in the sections 36. The nozzles 54 are each shown with two secondary fuel gas ports 59 that discharge secondary fuel gas upwardly and over the sections 36. As shown by the arrows, the deflector blocks 55 deflect the secondary fuel gas into two separated streams that do not mix and interact. This makes the flame more stable and lowers the burner $NO_X$ emissions.

Referring now to FIGS. 8 and 9, a perspective view and a top view of the burner tile 28 are shown, the burner tile 28 having two opposing right triangle shaped secondary fuel gas deflector blocks 57 attached to each of the sections 36. As best shown in FIG. 8, the sets of two opposing triangular deflector blocks are each positioned with the bases thereof coinciding with the tops of the sections 36 and the apexes pointing toward the nozzles 54. The nozzles 54 each have three secondary fuel gas ports 59 that discharge secondary fuel gas upwardly and over the sections 36, and the deflector blocks 57 deflect the secondary fuel gas into three stable separate streams that do not mix and interact thereby lowering burner $NO_X$ emissions.

Another problem that occurs when two or more burners of this invention are utilized in a single furnace is that the flames from one burner can interact with the flames of one or more adjacent burners. The interaction reduces the dilution of the fuel gas with flue gases and air which raises the $NO_X$ emissions. To solve this problem, a shut-off valve 61 is disposed in each conduit 56 connected to a fuel gas nozzle 54 (one of such valves being shown in FIG. 2). This allows the fuel gas to one or more nozzles 54 of the flame interacting burners to be turned off so that the flame interaction is stopped and $NO_X$ emissions are lowered.

In operation of the burner apparatus 10, fuel gas is introduced into the furnace space to which the burner 10 is attached and burned therein at a flow rate which results in the desired heat release. Air is also introduced into the burner housing 14 and a column of the air flows into the furnace space. The flow rate of air introduced into the furnace space is in the range of from about 0% to about 100% in excess of the flow rate of air required to form a stoichiometric mixture of air and fuel gas. Preferably, the flow rate of air is in excess of the stoichiometric flow rate of air by about 15%. Stated another way, the mixture of fuel gas and air discharged into the furnace space contains from about 0% to about 100% of excess air. As shown in FIG. 2, the column of air flows through the housing 14 and through the opening 32 in the burner tile 28 into the mixing zone formed within the interior and above the wall 34. While within the mixing zone, the air mixes with the primary fuel gas and flue gases discharged into the mixing zone by way of the passageways 42 and the fuel gas nozzles 54 positioned adjacent to the passageways 42 and optionally by way of the fuel gas nozzle 44. The resulting primary fuel gas-flue gases-air mixture containing a large excess of air is burned within and adjacent to the top of the burner tile 28 and the flue gases formed therefrom have very low $NO_x$ content due to the dilution of the fuel gas by the excess air and flue gases.

The secondary fuel gas discharged in directions parallel to the surfaces of the sections 36 and 38 by the nozzles 54 are mixed with flue gases surrounding the burner tile 28. The resulting secondary fuel gas-flue gases mixtures are discharged into the primary fuel gas-air mixture flowing from the interior of the wall 34 in a plurality of separate streams which form a folded flame pattern and mix with the primary fuel gas-air mixture to form a highly mixed fuel gas-flue gases-air mixture. The fuel gas-flue gases-air mixture burns in a multiplicity of folded flames in the furnace space and produces flue gases of low $NO_x$ content due to the fuel gas being diluted by relatively cool excess air and flue gases.

While the secondary fuel gas is preferably discharged by the nozzles 54 adjacent to the surfaces of all of the sections 36 and 38, it is to be understood that the secondary fuel gas can be discharged from two or more nozzles 54 adjacent to one or more of the sections 36 and one or more of the sections 38.

A preferred compact gas burner apparatus of this invention having a short flame length and a high turndown ratio for discharging a mixture of fuel gas and air into a furnace space wherein the mixture is burned and flue gases having low $NO_X$ content are formed therefrom comprises:

a housing having an open end attached to the furnace space;

means for introducing a controlled flow rate of the air into the housing attached thereto;

a burner tile attached to the open end of the housing having an opening formed therein for allowing the air to flow therethrough and having a wall surrounding the opening which extends into the furnace space, the exterior sides of the wall being divided into sections by a plurality of radially positioned baffles attached thereto with alternate sections having different heights and slanting towards the opening at different angles and one or more of the alternating sections having primary fuel gas passageways formed therein for conducting primary fuel gas from outside the section to within the wall;

a plurality of fuel gas nozzles connected to a source of fuel gas and positioned outside the wall of the burner tile for discharging secondary fuel gas adjacent to the external slanted wall sections with one or more of the fuel gas nozzles also discharging primary fuel gas mixed with flue gases into and through the primary fuel gas passageways whereby the secondary fuel gas mixes with flue gases in the furnace space, the mixture of secondary fuel gas and flue gases mixes with unburned air, primary fuel gas and flue gases flowing through the opening and wall of the burner tile and the resultant mixture is burned in the furnace space; and the one or more of the alternating sections with primary fuel gas passageways formed therein having one or more deflectors attached thereto for deflecting the secondary fuel gas into separate streams that do not interact with each other.

Another preferred compact gas burner apparatus of this invention having a folded flame pattern, a short flame length and a high turndown ratio for discharging a mixture of fuel gas and air into a furnace space wherein the mixture is burned and flue gases having low $NO_X$ content are formed therefrom comprises:

a housing having an open end attached to the furnace space;

an air register for introducing a controlled flow rate of air into the housing attached thereto;

a burner tile attached to the open end of the housing having an opening formed therein for allowing the air to flow therethrough and having a wall surrounding the opening which extends into the furnace space, the exterior sides of the wall being divided into sections by a plurality of radially positioned baffles attached thereto, a first of the alternating wall sections having a short height and slanting towards the opening at a large angle, the second of the wall sections having a taller height and slanting towards the opening at a smaller angle and successive alternating sections having heights and angles which are the same as the first and second sections, every other of the slanted wall sections also having passageways formed therein for conducting primary fuel gas and flue gases into the interior of the wall;

a plurality of fuel gas nozzles connected to a source of fuel gas and positioned outside the wall of the burner tile for discharging secondary fuel gas adjacent to the slanted wall sections whereby the secondary fuel gas mixes with flue gases in the furnace space, a portion of the fuel gas nozzles discharging primary fuel gas mixed with flue gases through the passageways in the slanted wall sections into the interior of the burner tile wherein the primary fuel gas and flue gases mix with air therein and the resultant mixture of unburned air, primary fuel gas and flue gases flowing through the opening and wall in the burner tile mixes with the secondary fuel gas mixed with flue gases and the resultant mixture is burned in the furnace space in the folded flame pattern; and the slanted wall sections with passageways formed therein having one or more deflectors attached thereto for deflecting the secondary fuel gas into separate streams that do not interact with each other.

A preferred method of this invention for discharging a mixture of fuel gas and air into a furnace space by way of an opening therein wherein the mixture is burned in a folded flame pattern and flue gases having low $NO_x$ content are formed therefrom comprises the steps of: (a) discharging the air into a mixing zone within and adjacent to a wall which extends into the furnace space and has exterior sides divided into alternating sections by a plurality of radially positioned baffles attached thereto, the alternating sections having different heights and slanting towards the opening at different angles and one or more of the alternating sections having a passageway formed therein for conducting a primary fuel gas and flue gases mixture from outside the section to within the wall; (b) discharging a primary portion of the fuel gas from locations outside the wall and adjacent to the one or more wall sections having passageways formed therein so that the primary portion of the fuel gas is mixed with flue gases in the furnace space and the resulting primary fuel gas-flue gases mixture formed flows into the mixing zone within the wall by way of said passageways to form a primary fuel gas-flue gases air mixture which flows into the furnace space; and (c) discharging a secondary portion of the fuel gas from two or more locations outside the wall and adjacent to two or more of the wall sections having different heights so that the secondary portions of fuel gas mix with flue gases in the furnace space and the secondary fuel gas-flue gases mixtures formed are discharged into the primary fuel gas-flue gases-air mixture in two or more separate streams formed by the radially positioned baffles which enter and mix with the primary fuel gas-flue gases-air mixture to form a highly mixed fuel gas-flue gases-air mixture which burns in the folded flame pattern, the one or more wall sections with passageways formed therein having one or more deflectors attached thereto for deflecting the secondary portion of the fuel gas into separate streams that do not interact with each other.

The above method can also include the optional step of introducing a portion of the primary fuel gas into the mixing zone within the wall of the burner tile whereby the primary fuel gas mixes with air therein.

The fuel gas, flue gases and air discharged into the furnace space in accordance with step (b) can contain from about 0% to about 100% of excess air. The primary portion of fuel gas utilized in accordance with step (b) is in the range of from about 2% to about 40% by volume of the total fuel gas discharged into the furnace space and the secondary portion of fuel gas utilized in accordance with step (c) is in the range of from about 60% to about 98% by volume of the total fuel gas discharged into the furnace space.

Another preferred method of this invention for discharging a fuel gas and air mixture into a furnace space by way of an opening therein wherein the mixture is burned in a folded flame pattern and flue gases having low $NO_x$ content are formed therefrom comprises the steps of: (a) discharging a column of the air into the furnace space by way of a cylindrical wall which extends into said furnace space and has exterior sides divided into alternating sections having different heights and slanting towards said opening at different angles, the wall having at least one opening therein for conducting a first portion of the fuel gas mixed with flue gases from outside the wall to within the wall; (b) discharging the first portion of the fuel gas mixed with flue gases from the furnace space into the column of the air; and (c) discharging a second portion of the fuel gas mixed with flue gases from the furnace space into the column of air containing the first portion of the fuel gas mixed with flue gases in separate streams from locations outside the wall and adjacent to the alternating sections, the separate streams entering the column radially and burning therein along with the first portion of the fuel gas in separate folded flames surrounded by and mixed with flue gases and air, and the alternating sections having passageways therein also having one or more deflectors attached thereto for deflecting the secondary portion of the fuel gas into separate streams that do not interact with each other.

In order to further illustrate the apparatus of this invention, its operation and the methods of the invention, the following examples are given.

EXAMPLE 1

A burner apparatus 10 designed for a heat release of 8,000,000 BTU per hour by burning natural gas having a caloric value of 913 BTU/SCF was fired into a furnace space. Pressurized fuel gas was supplied to the manifold 48 of the burner 10 at a pressure of about 33 psig and a flow rate of about 8765 SCF/hour. A 20% by volume portion of the fuel gas (1753 SCF/hour) was used as primary fuel gas and was discharged within the opening 32 and wall 34 of the burner tile 28 by the fuel gas discharge nozzle 44 and by the fuel gas discharge nozzles 54 positioned adjacent to the openings 42 in the wall 40 of the burner tile 28. The remaining portion of the fuel gas, i.e., the secondary portion (at a rate of 7012 SCF/hour) was discharged into the furnace space by the nozzles 54 in separate fuel gas streams mixed with flue gases.

The rate of air introduced into the furnace space by way of the air register 24, the housing 14 and the burner tile 28 was at least 15% in excess of the stoichiometric air rate relative to the total fuel gas rate. The primary fuel gas-flue gases air mixture began to burn at the vicinity of the passages 42 and at the top of the burner tile wall 34. The fuel gas-flue gases mixtures discharged at different angles into the partially burning fuel gas-air-flue gases mixture at the top of the burner tile wall 34 intimately mixed with flue gases from the furnace space and remaining air therein and burned above the burner tile in a short flame having a folded flame pattern. Because of the dilution of the primary and secondary fuel gases with flue gases and excess air and the intimate mixing of the fuel gas-air-flue gases mixture, the burner had a high turn down ratio and produced very low $NO_x$ emissions. Finally, the burner apparatus 10 has compact dimensions (significantly smaller than other low $NO_x$ burners) and can be easily installed in existing furnaces.

EXAMPLE 2

In order to see the flame pattern produced by the burner apparatus 10 when operated as described in Example 1 above, a computer simulation program was utilized. The software used was obtained from Fluent Inc. of Lebanon, N.H. The design of the burner was reconstructed in the simulation program in full three dimensional detail including all important features such as tile facets, fuel gas port drillings, flame holder tile ledge and complete air plenum configuration.

A three dimensional model of the furnace in which the burner apparatus was tested was then prepared and the burner model was mounted in the furnace model exactly like the test burner and furnace utilized in Example 1 except that the air entered the housing from the side instead of the bottom. The flow spaces in the burner model were divided into small volumes using the finite volume method and boundary conditions were applied, e.g., fuel pressure, flow rates, etc. at the entrances of the burner model. The software then calculated and predicted the flow patterns as well as combustion reactions and the resulting flame pattern by iteratively calculating values for all the combustion and flow parameters in each of the small volumes.

The calculations were repeated until the predicted error was reduced to a desired level and then the output (a table of values for each volume) was fed into a graphics software package that produced a profile of static temperatures at planes cut through the flame at elevations of interest. One such elevation is presented in FIG. 5.

As shown in FIG. 5, the flame pattern includes eight folded flames 60 corresponding to the eight sections 36 and 38 of the burner tile having breaks 62 between the folds. The center flame 64 is produced by the burning of the fuel discharged from the fuel gas nozzle 44.

As mentioned previously herein, the separate folded flames 60 allow the fuel gas to be rapidly mixed with flue gases prior to burning with air thereby reducing the flame temperature and production of $NO_x$. Also, the increased surface of the folded flames 60 and the breaks 62 that exist between the folds allow flue gases to penetrate the flames and mix therewith to a greater degree than has heretofore been possible. Consequently, the $NO_x$ emissions content of the flue gases released to the atmosphere is very low.

Thus, the present invention is well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. A compact gas burner apparatus having a short flame length and a high turndown ratio for discharging a mixture of fuel gas and air into a furnace space wherein the mixture is burned and flue gases having low $NO_x$ content are formed therefrom comprising:

a housing having an open end attached to said furnace space;

means for introducing a controlled flow rate of said air into said housing attached thereto;

a burner tile attached to the open end of said housing having an opening formed therein for allowing said air to flow therethrough and having a wall surrounding said opening which extends into said furnace space, the exterior sides of said wall being divided into sections by a plurality of radially positioned baffles attached thereto with alternate sections having different heights and slanting towards said opening at different angles and one or more of the alternating sections having primary fuel gas passageways formed therein for conducting primary fuel gas from outside said section to within said wall;

a plurality of fuel gas nozzles connected to a source of fuel gas and positioned outside said wall of said burner tile for discharging secondary fuel gas adjacent to said external slanted wall sections with one or more of said fuel gas nozzles also discharging primary fuel gas mixed with flue gases into and through said primary fuel gas passageways whereby said secondary fuel gas mixes with flue gases in said furnace space, the mixture of secondary fuel gas and flue gases mixes with unburned air, primary fuel gas and flue gases flowing through said opening and wall of said burner tile, and the resultant mixture is burned in said furnace space; and said one or more of said alternating sections with primary fuel gas passageways formed therein having one or more deflectors attached thereto for deflecting the secondary fuel gas into separate streams that do not interact with each other.

2. The burner apparatus of claim 1 wherein said radially positioned baffles attached to said burner tile extend in directions parallel to the axis of said burner tile wall whereby said secondary fuel gas and flue gases are divided into a plurality of separate streams which mix with said primary fuel gas and unburned air flowing through said opening and wall of said burner tile.

3. The burner apparatus of claim 1 wherein a first of said alternating wall sections has a short height and slants towards said opening in said burner tile at a large angle, the second of said wall sections has the same or a taller height and slants towards said opening at the same or a smaller angle and successive alternating sections have heights and angles which are the same as said first and second sections.

4. The burner apparatus of claim 3 wherein said first of said alternating sections have heights in the range of from about 0 inches to about 16 inches and slant towards said opening at an angle in the range of from about 0 degrees to about 90 degrees, and the second of said alternating sections have the same or different heights as the first of said alternating sections in the range of from about 2 inches to about 16 inches and slant towards said opening at the same or different angles in the range of from about 0 degrees to about 60 degrees.

5. The burner apparatus of claim 3 wherein said first of said alternating sections have heights in the range of from about 5 inches to about 10 inches and slant towards said opening at an angle in the range of from about 10 degrees to about 30 degrees, and the second of said alternating sections have the same or different heights as the first of said alternating sections in the range of from about 6 inches to about 12 inches and slant towards said opening at the same or different angles in the range of from about 5 degrees to about 15 degrees.

6. The burner apparatus of claim 3 wherein said first of said alternating sections have heights of about 7 inches and slant towards said opening at an angle of about 20 degrees, and the second of said alternating sections have heights of about 9 inches and slant towards said opening at an angle of about 10 degrees.

7. The burner apparatus of claim 3 wherein said passageways are located in said slanted wall sections which have short heights and slant towards said opening in said burner tile at large angles, said passageways being positioned whereby primary fuel gas discharged from said fuel gas nozzles mixes with flue gases and flows through said passageways into the interior of said wall of said burner tile wherein the mixture mixes with air.

8. The burner apparatus of claim 1 wherein said burner tile, said opening therein and the interior of said wall of said burner tile are substantially circular, rectangular, square, triangular, polygonal or other shape.

9. The burner apparatus of claim 1 wherein said open end of said housing is circular, square, triangular, polygonal or other shape and said housing is cylindrical, square, rectangular, triangular, polygonal or other shape.

10. The burner apparatus of claim 1 which optionally further comprises a primary fuel gas nozzle connected to a source of fuel gas positioned within said opening and wall of said burner tile for mixing additional primary fuel gas with said air flowing through said burner tile and discharging the mixture into said furnace space.

11. The burner apparatus of claim 10 which optionally further comprises a venturi positioned around and above said additional primary fuel gas nozzle.

12. The burner apparatus of claim 1 which optionally further comprises a flame stabilizing surface within said opening of said burner tile.

13. The burner apparatus of claim 2 wherein said separate streams of secondary fuel gas and flue gases mixed with said unburned air and primary fuel gas are burned in said furnace space in a folded flame pattern which produces flue gases having low $NO_x$ content.

14. The burner apparatus of claim 1 wherein said one or more deflectors attached to said alternating sections with primary fuel gas passageways formed therein are one or more deflector blocks of various shapes including triangular, rectangular, square and trapezoidal.

15. The burner apparatus of claim 14 wherein said one or more deflector blocks are of triangular shapes positioned with the bases thereof coinciding with the tops of said alternating sections with primary fuel gas passageways therein and the apexes thereof pointing towards the passageways formed therein.

16. The burner apparatus of claim 14 wherein one deflector block is attached to each of said alternating sections with primary fuel gas passageways formed therein.

17. The burner apparatus of claim 14 wherein two or more deflector blocks are attached to each of said alternating sections with primary fuel gas passageways therein.

18. The burner apparatus of claim 1 wherein said fuel gas nozzles are each connected to a source of fuel gas by separate conduits having shut-off valves disposed therein whereby said fuel gas to one or more fuel gas nozzles can be shut off when required.

19. A compact gas burner apparatus having a folded flame pattern, a short flame length and a high turndown ratio for discharging a mixture of fuel gas and air into a furnace space wherein the mixture is burned and flue gases having low $NO_x$ content are formed therefrom comprising:

a housing having an open end attached to said furnace space;

an air register for introducing a controlled flow rate of air into said housing attached thereto;

a burner tile attached to the open end of said housing having an opening formed therein for allowing said air to flow therethrough and having a wall surrounding said opening which extends into said furnace space, the exterior sides of said wall being divided into sections by a plurality of radially positioned baffles attached thereto, a first of said alternating wall sections having a short height and slanting towards said opening at a large angle, the second of said wall sections having a taller height and slanting towards said opening at a smaller angle and successive alternating sections having heights and angles which are the same as said first and second sections, every other of said slanted wall sections also having passageways formed therein for conducting primary fuel gas and flue gases into the interior of said wall;

a plurality of fuel gas nozzles connected to a source of fuel gas and positioned outside said wall of said burner tile for discharging secondary fuel gas adjacent to said slanted wall sections whereby said secondary fuel gas mixes with flue gases in said furnace space, a portion of said fuel gas nozzles discharging primary fuel gas mixed with flue gases through said passageways in said slanted wall sections into the interior of said burner tile wherein said primary fuel gas and flue gases mix with air therein and the resultant mixture of unburned air, primary fuel gas and flue gases flowing through said opening and wall in said burner tile mixes with said secondary fuel gas mixed with flue gases and the resultant mixture is burned in said furnace space in said folded flame pattern; and said slanted wall sections with passageways formed therein having one or more deflectors attached thereto for deflecting the secondary fuel gas into separate streams that do not interact with each other.

20. The burner apparatus of claim 19 wherein said radially positioned baffles attached to said burner tile extend in directions parallel to the axis of said burner tile wall whereby said secondary fuel gas and flue gases are divided into a plurality of separate streams which mix with said primary fuel gas and unburned air flowing through said opening and wall of said burner tile.

21. The burner apparatus of claim 19 wherein said first of said alternating sections have heights in the range of from about 0 inches to about 16 inches and slant towards said opening at an angle in the range of from about 0 degrees to about 90 degrees, and the second of said alternating sections have the same or different heights as the first of said alternating sections in the range of from about 2 inches to about 16 inches and slant towards said opening at the same or different angles in the range of from about 0 degrees to about 60 degrees.

22. The burner apparatus of claim 19 wherein said first of said alternating sections have heights in the range of from about 5 inches to about 10 inches and slant towards said opening at an angle in the range of from about 10 degrees to about 30 degrees, and the second of said alternating sections have the same or different heights as the first of said alternating sections in the range of from about 6 inches to about 12 inches and slant towards said opening at the same or different angles in the range of from about 5 degrees to about 15 degrees.

23. The burner apparatus of claim 19 wherein said first of said alternating sections have heights of about 7 inches and slant towards said opening at an angle of about 20 degrees, and the second of said alternating sections have heights of about 9 inches and slant towards said opening at an angle of about 10 degrees.

24. The burner apparatus of claim 19 wherein said burner tile, said opening therein and the interior and said wall of said burner tile are substantially circular, rectangular, square, triangular, polygonal or other shape.

25. The burner apparatus of claim 19 wherein said open end of said housing is circular, square, triangular, polygonal or other shape and said housing is cylindrical, square, rectangular, triangular, polygonal or other shape.

26. The burner apparatus of claim 19 which optionally further comprises at least one primary fuel gas nozzle connected to a source of fuel gas positioned within said opening and wall of said burner tile for mixing additional primary fuel gas with said air flowing through said burner tile and discharging the mixture into said furnace space.

27. The burner apparatus of claim 19 which further comprises a venturi positioned around and above said primary fuel gas nozzle.

28. The burner apparatus of claim 19 which further comprises a flame stabilizing surface within said opening of said burner tile.

29. The burner apparatus of claim 19 wherein said one or more deflectors attached to said alternating sections with primary fuel gas passageways formed therein are one or more deflector blocks of various shapes including triangular, rectangular, square and trapezoidal.

30. The burner apparatus of claim 29 said one or more deflector blocks are of triangular shapes positioned with the bases thereof coinciding with the tops of said alternating sections with primary fuel gas passageways therein and the apexes thereof pointing towards the passageways formed therein.

31. The burner apparatus of claim 29 wherein one deflector block is attached to each of said alternating sections with primary fuel gas passageways formed therein.

32. The burner apparatus of claim 29 wherein two or more deflector blocks are attached to each of said alternating sections with primary fuel gas passageways therein.

33. The burner apparatus of claim 19 wherein said fuel gas nozzles are each connected to a source of fuel gas by separate conduits having shut-off valves disposed therein whereby said fuel gas to one or more fuel gas nozzles can be shut off when required.

34. A method of discharging a mixture of fuel gas and air into a furnace space by way of an opening therein wherein said mixture is burned in a folded flame pattern and flue gases having low $NO_x$ content are formed therefrom comprising the steps of:

(a) discharging said air into a mixing zone within and adjacent to a wall which extends into said furnace space and has exterior sides divided into alternating sections by a plurality of radially positioned baffles attached thereto, the alternating sections having different heights and slanting towards said opening at different angles and one or more of the alternating sections having passageways formed therein for conducting a primary fuel gas and flue gases mixture from outside said section to within said wall;

(b) discharging a primary portion of said fuel gas from locations outside said wall and adjacent to said one or more wall sections having passageways formed therein so that said primary portion of said fuel gas is mixed with flue gases in said furnace space and the resulting primary fuel gas-flue gases mixture formed flows into said mixing zone within said wall by way of said passageways to form a primary fuel gas-flue gases-air mixture which flows into said furnace space; and (c) discharging a secondary portion of said fuel gas from two or more locations outside said wall and adjacent to two or more of said wall sections having different heights so that said secondary portions of fuel gas mix with flue gases in said furnace space and the secondary fuel gas-flue gases mixtures formed are discharged into said primary fuel gas-flue gases-air mixture in two or more separate streams formed by said radially positioned baffles which enter and mix with said primary fuel gas-flue gases-air mixture to form a highly mixed fuel gas-flue gases-air mixture which burns in said folded flame pattern, the one or more wall sections with passageways formed therein having one or more deflectors attached thereto for deflecting the secondary portion of the fuel gas into separate streams that do not interact with each other.

35. The method of claim 34 wherein said mixture of fuel gas, flue gases and air discharged into said furnace space in accordance with step (b) contains from 0% to about 100% of excess air.

36. The method of claim 34 wherein said primary portion of said fuel gas used to form said primary fuel gas-air mixture in accordance with step (b) is in the range of from about 2% to about 40% by volume of the total fuel gas discharged into said furnace space.

37. The method of claim 34 wherein said secondary portion of fuel gas used to form said secondary fuel gas-flue gases mixtures in accordance with step (c) is in the range of from about 60% to about 98% by volume of the total fuel gas discharged into said furnace space.

38. The method of claim 34 wherein said wall is formed of refractory material and is part of a refractory tile having an opening within said wall.

39. The method of claim 34 wherein a first of said alternating wall sections has a short height and slants towards said opening at a small angle, the second of said wall sections has a taller height and slants towards said opening at a larger angle and successive alternating sections have heights and angles which are the same as said first and second sections.

40. The method of claim 34 wherein said one or more deflectors attached to said alternating sections with primary fuel gas passageways formed therein are one or more deflector blocks of various shapes including triangular, rectangular, square and trapezoidal.

41. The method of claim 40 wherein said one or more deflector blocks are of triangular shapes positioned with the bases thereof coinciding with the tops of said alternating sections with primary fuel gas passageways therein and the apexes thereof pointing towards the passageways formed therein.

42. The method of claim 40 wherein one deflector block is attached to each of said alternating sections with primary fuel gas passageways formed therein.

43. The method of claim 40 wherein two or more deflector blocks are attached to each of said alternating sections with primary fuel gas passageways therein.

44. The method of claim 34 wherein said fuel gas nozzles are each connected to a source of fuel gas by separate conduits having shut-off valves disposed therein whereby said fuel gas to one or more fuel gas nozzles can be shut off when required.

45. A method of discharging a fuel gas and air mixture into a furnace space by way of an opening therein wherein said mixture is burned in a folded flame pattern and flue gases having low $NO_x$ content are formed therefrom comprising the steps of:

(a) discharging a column of said air into said furnace space by way of a cylindrical wall which extends into said furnace space and has exterior sides divided into alternating sections having different heights and slanting towards said opening at different angles, said wall having at least one opening therein for conducting a first portion of said fuel gas mixed with flue gases from outside said wall to within said wall;

(b) discharging said first portion of said fuel gas mixed with flue gases from said furnace space into said column of said air; and (c) discharging said second portion of said fuel gas mixed with flue gases from said furnace space into said column of air containing said first portion of fuel gas mixed with flue gases in separate streams from locations outside said wall and adjacent to said alternating sections, said separate streams entering said column radially and burning therein along with said first portion of said fuel gas in separate folded flames surrounded by and mixed with flue gases and air and said alternating sections having passageways therein also having one or more deflectors attached thereto for deflecting said secondary portion of said fuel gas into separate streams that do not interact with each other.

46. The method of claim 45 which optionally further comprises the step of discharging a part of said first portion of said fuel gas into said column of air prior to step (a).

47. The method of claim 45 wherein said mixture of fuel gas and air discharged into said furnace space contains from 0% to about 100% of excess air.

48. The method of claim 45 wherein said first portion of said fuel gas is in the range of from about 2% to about 40% by volume of the total fuel gas discharged into said column of air.

49. The method of claim 30 wherein said second portion of said fuel gas is in the range of from about 60% to about 98% by volume of the total fuel gas discharged.

50. The method of claim 45 wherein said one or more deflectors attached to said alternating sections with primary fuel gas passageways formed therein are one or more deflector blocks of various shapes including triangular, rectangular, square and trapezoidal.

51. The method of claim 49 wherein said one or more deflector blocks are of triangular shapes positioned with the bases thereof coinciding with the tops of said alternating sections with primary fuel gas passageways therein and the apexes thereof pointing towards the passageways formed therein.

52. The method of claim 49 wherein one deflector block is attached to each of said alternating sections with primary fuel gas passageways formed therein.

53. The method of claim 49 wherein two or more deflector blocks are attached to each of said alternating sections with primary fuel gas passageways therein.

54. The method of claim 45 wherein said fuel gas nozzles are each connected to a source of fuel gas by separate conduits having shut-off valves disposed therein whereby said fuel gas to one or more fuel gas nozzles can be shut off when required.

* * * * *